US011346095B2

(12) United States Patent
Say et al.

(10) Patent No.: US 11,346,095 B2
(45) Date of Patent: May 31, 2022

(54) FLOOR SINK

(71) Applicant: Zurn Industries, LLC, Milwaukee, WI (US)

(72) Inventors: Christopher J. Say, Waterford, PA (US); Lisa A. Barker, Cranesville, PA (US)

(73) Assignee: ZURN INDUSTRIES, LLC, Milwaukee, WI (US)

( * ) Notice: Subject to any disclaimer, the term of this patent is extended or adjusted under 35 U.S.C. 154(b) by 0 days.

(21) Appl. No.: 17/084,465

(22) Filed: Oct. 29, 2020

(65) Prior Publication Data

US 2021/0131088 A1 May 6, 2021

Related U.S. Application Data

(60) Provisional application No. 62/928,908, filed on Oct. 31, 2019.

(51) Int. Cl.
*E03F 5/04* (2006.01)
*E03F 5/06* (2006.01)
*E03C 1/26* (2006.01)

(52) U.S. Cl.
CPC ..... *E03F 5/0407* (2013.01); *E03C 1/26* (2013.01); *E03F 5/06* (2013.01)

(58) Field of Classification Search
CPC .. E03F 5/0407; E03F 5/06; E03C 1/26; E04D 13/0409
USPC ..... 210/163, 164; 4/679, 286, 289, 292; 52/302.1
See application file for complete search history.

(56) References Cited

U.S. PATENT DOCUMENTS 4,321,713 A * 3/1982 Thompson ..... E03C 1/26 4/286
4,345,998 A * 8/1982 Graffis ..... E03F 5/0401 210/164
4,910,811 A * 3/1990 Izzi, Sr. ..... E03F 5/0407 210/163
8,628,657 B1 * 1/2014 Robillard ..... E03F 5/0407 210/163
2018/0266094 A1 * 9/2018 Priester ..... E03F 5/0407

OTHER PUBLICATIONS

Zurn, "Floor Sink—Z1900 12"×12" Sani-Flor Receptor 6" Sump Depth", website: https://www.zurn.com/products/building-drainage/floor-sinks/z1900, Copyright 2020, (3 Pages).
Zurn, "Z1900 12×12 [305×305] A.R.E. Sani-Flor Receptor 6 [152] Sump Depth", Specification Sheet, Sep. 28, 2017 Rev. M, (1 Page).
Zurn, "Common Components Z1900-2/3/4-32/33", Specification Sheet, Aug. 14, 2018 Rev. A, (2 Pages).

* cited by examiner

*Primary Examiner* — Christopher Upton
(74) *Attorney, Agent, or Firm* — Michael Best & Friedrich LLP

(57) ABSTRACT

A floor sink configured to be installed in a support surface includes a body including a first end, and a second end opposite the first end and configured to receive a pipe. The floor sink further includes a cavity extending through the body, and a flange coupled to the first end of the body and extending away from the cavity. The flange is configured to engage the support surface.

12 Claims, 7 Drawing Sheets

FLOOR SINK

CROSS-REFERENCE TO RELATED APPLICATIONS

This application claims priority to U.S. Provisional Patent Application No. 62/928,908, filed on Oct. 31, 2019, the entire contents of which are incorporated herein by reference.

FIELD OF THE INVENTION

The present disclosure relates to a floor sink, and more specifically, to a floor sink including a flange.

BACKGROUND

Floor sinks are installed in finished floors to collect and provide a drain passage for fluid. Floor sinks are occasionally installed above the level of the finished floor per certain plumbing codes to ensure that only directed water (e.g., condensation) enters the floor sink, and indirect waste (e.g., debris from the floor) does not enter the drain. When floor sinks are installed above the level of the floor, a gap is formed between the floor sink and the floor. Typically, this gap is filled with grout, which can cause potential sanitation issues.

SUMMARY

In one aspect, the invention provides a floor sink configured to be installed in a support surface, including a body including a first end, and a second end opposite the first end and configured to receive a pipe, a cavity extending through the body, and a flange coupled to the first end of the body and extending away from the cavity, wherein the flange is configured to engage the support surface.

In another aspect, the invention provides a floor sink configured to be installed in a support surface, including a body including a first end, and a second end opposite the first end and configured to receive a pipe, a cavity extending through the body, and a flange coupled to the first end of the body and extending away from the cavity, the flange including a first wall, a second wall oriented perpendicular to the first wall, and a channel formed between the first wall and the second wall.

In yet another aspect, the invention provides a floor sink configured to be installed in a support surface, including a body including an inlet, an outlet opposite the inlet and configured to receive a pipe, a first wall, and a second wall axially extending from the first wall, a cavity extending through the body, and a flange coupled to the second wall and extending away from the cavity, wherein the flange is configured to engage the support surface.

Other aspects of the disclosure will become apparent by consideration of the detailed description and accompanying drawings.

DETAILED DESCRIPTION

Figure 1:
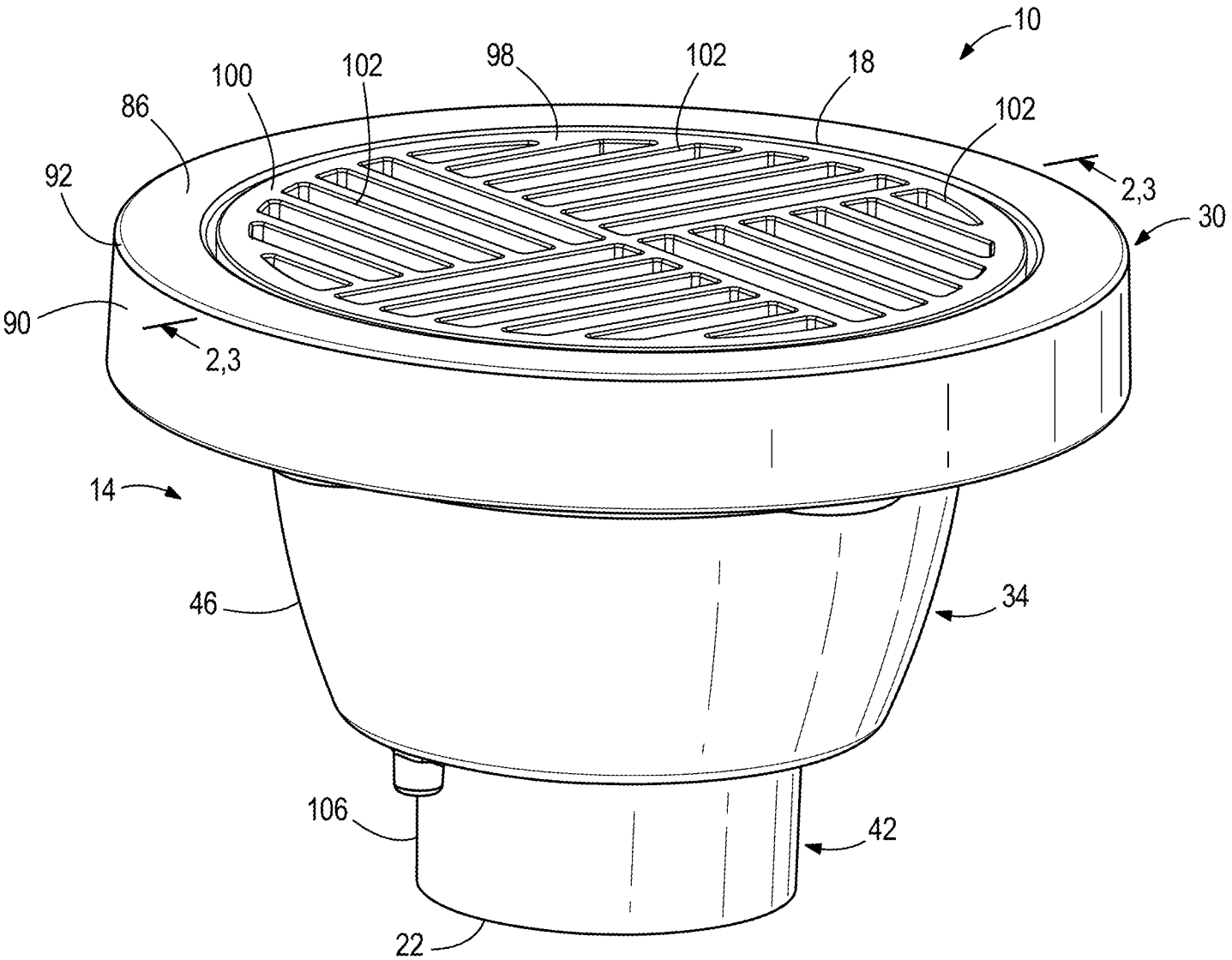
FIG. 1 is a front perspective view of a floor sink embodying the invention.

Before any embodiments of the disclosure are explained in detail, it is to be understood that the disclosure is not limited in its application to the details of the formation and arrangement of components set forth in the following description or illustrated in the accompanying drawings. The disclosure is capable of supporting other implementations and of being practiced or of being carried out in various ways.

The figures and accompanying description provide a floor sink 10. The floor sink 10 may be provided as a drain passage for condensation and fluids. The floor sink 10 may be installed directly in a surrounding floor surface, or may be positioned slightly above the floor surface depending upon the needs of the user.

FIGS. 1-6 illustrate the floor sink 10 according to an embodiment of the present disclosure. The floor sink 10 includes a body 14 having a first end 18, or inlet, a second end 22, or outlet, opposite the first end 18, and a cavity 26 extending through the body 14. The second end 22 of the body 14 is configured to receive a conduit or pipe. The first end 18 of the body 14 additionally includes an annular flange 30 extending away from the cavity 26 of the body 14.

With reference to FIGS. 1-4, the body 14 is cylindrical and is shaped and sized to be received within a surrounding floor surface. The body 14 includes a main body portion 34, an upper body portion 38 adjacent the first end 18 of the body 14, and a lower body portion 42 adjacent the second end 22 of the body 14. The main body portion 34 extends between the upper body portion 38 and the lower body portion 42.

The main body portion 34 is cylindrically shaped and includes a contoured wall 46 and an angled wall 50. The contoured wall 46 is positioned above the angled wall 50. The contoured wall 46 includes a first end 46*a*, and a second end 46*b* opposite the first end 46*a*. Similarly, the angled wall 50 includes a first end 50*a*, and a second end 50*b* opposite the first end 50*a*. The contoured wall 46 extends between the upper body portion 38 and the angled wall 50, and the angled wall 50 extends between the contoured wall 46 and the lower body portion 42. Specifically, the first end 46*a* of the contoured wall 46 is in connection with the upper body portion 38 and the second end 46*b* of the contoured wall 46 is in connection with the angled wall 50. The contoured wall 46 and the angled wall 50 are shaped and sized to receive a strainer 54 within the main body portion 34. Specifically, the strainer 54 may be positioned on an edge 58 formed between the contoured wall 46 and the angled wall 50. The strainer 54 includes several openings 60 extending through the strainer 54. Specifically, the openings 60 are elongated slots; however, in alternative embodiments, the openings 60 may include different shapes (e.g., circular). The openings 60 are configured to permit the passage of fluid, while preventing large objects and debris through the strainer 54.

In alternative embodiments, the contoured wall 46 and the angled wall 50 may be alternatively shaped and sized in order to accommodate strainers of alternative shapes and/or sizes. A fastener 62 is inserted into the strainer 54 and the angled wall 50 in order to secure the strainer 54 to the main body portion 34.

The upper body portion 38 is cylindrically shaped. Specifically, the upper body portion 38 includes a radially extending wall 66 and an axially extending wall 70. The radially extending wall 66 extends radially outward from a first end 46*a* of the contoured wall 46. The axially extending wall 70 extends axially upwards from the radially extending wall 66 and includes a first end 70*a*, and a second end 70*b* opposite the first end 70*a*. The second end 70*b* of the axially extending wall 70 is in connection with the first end 46*a* of the contoured wall 46. The upper body portion 38 additionally includes a radial ledge 74 protruding from an inner surface of the axially extending wall 70 and the radially extending wall 66. The ledge 74 is cylindrical and includes four semi-circular, equidistantly-spaced recesses 78. The recesses 78 are shaped and sized to receive a sediment basket 82, or alternative strainer, within the body 14 of the floor sink 10. The sediment basket 82 includes several openings 84 extending through the basket 82. Specifically, the openings 84 are elongate slots; however, alternative embodiments, the openings 84 may include different shapes (e.g., circular). Similarly to the openings 84 on the strainer 54, the openings 84 are configured to permit the passage of fluid, while preventing large objects and debris, through the basket 82. In alternative embodiments, the ledge 74 and/or the recesses 78 may be alternatively shaped in order to accommodate sediment baskets of different shapes and sizes.

The flange 30 extends from a first end 70*a* of the axially extending wall 70 of the upper body portion 38. The flange 30 includes a radially extending wall 86 and an axially extending wall 90. The radially extending wall 86 extends radially outward from the first end 70*a* of the axially extending wall 70 of the upper body portion 38. The axially extending wall 90 includes a first end 90*a* and a second end 90*b* and extends axially downward from an outermost edge 92 of the radially extending wall 86 of the flange 30 and thereby forming a channel. Specifically, the radially extending wall 86 and the axially extending wall 90 are oriented substantially perpendicular to each other. The axially extending wall 90 of the flange 30 is substantially parallel to the axially extending wall 70 of the upper body portion 38. The radially extending wall 86 and the axially extending wall 90 are shaped such that the flange 30 is circular. However, in alternative embodiments, the flange 30 may include alternative shapes. The flange 30 additionally includes various ribs 94 extending between an outer surface of the axially extending wall 70 of the upper body portion 38 and an inner surface of the axially extending wall 90 of the flange 30. The ribs 94 provide additional strength and support of the flange 30.

Figure 3:
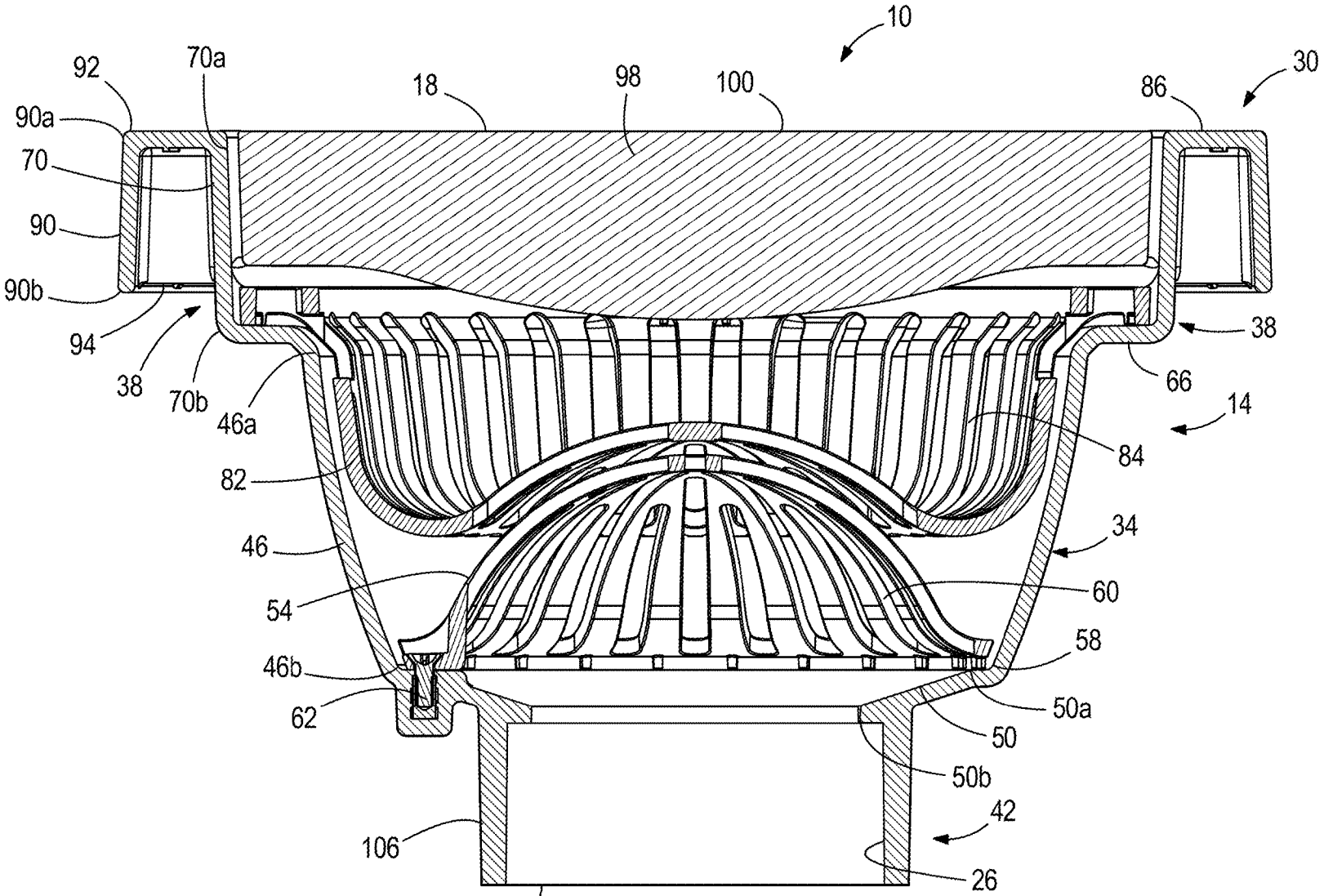
FIG. 3 is another front cross-section view of the floor sink of FIG. 1, including additional removable components.
Figure 4:
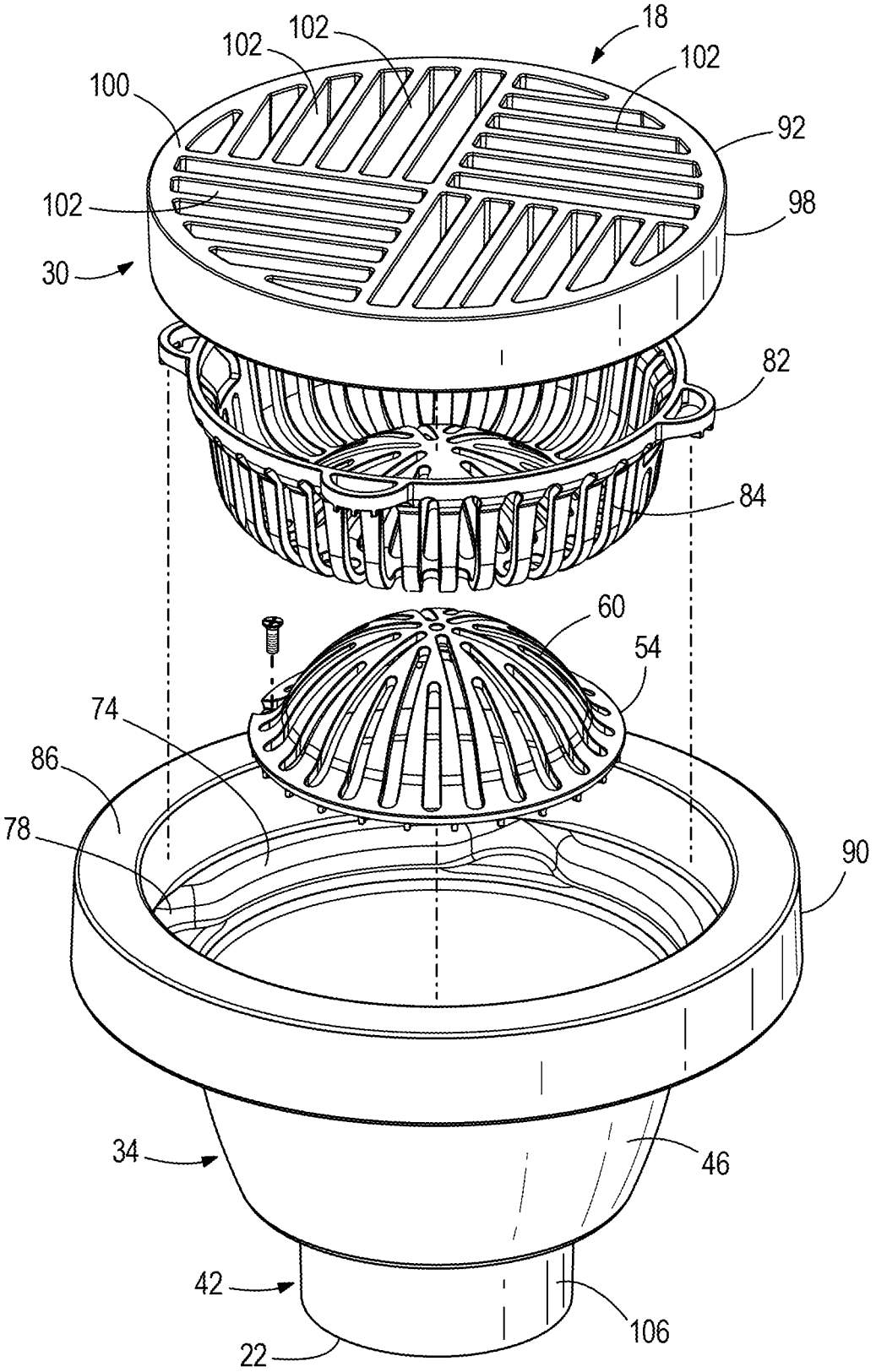
FIG. 4 is an exploded view of the floor sink of FIG. 1.
Figure 5:
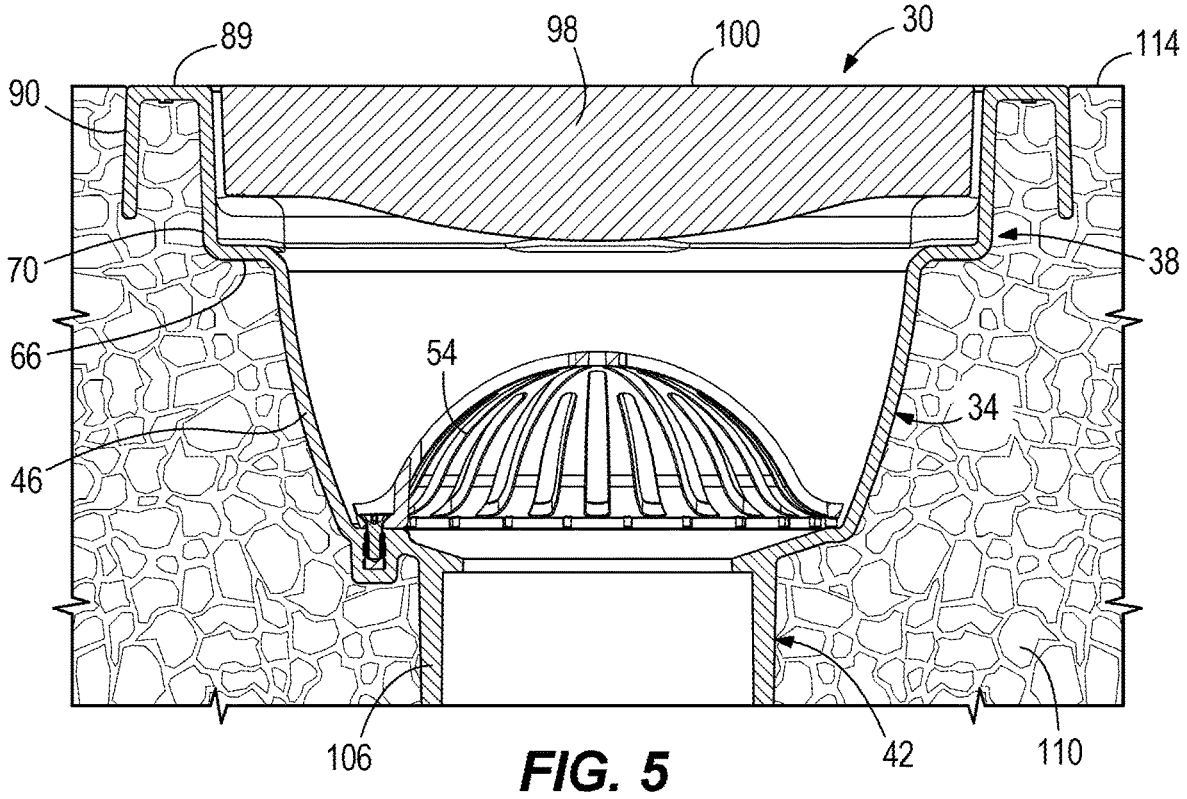
FIG. 5 is a front cross-sectional view of the floor sink of FIG. 1 positioned below a support surface.

With reference to FIG. 3, the upper body portion 38 is sized to receive a grate 98, or alternative cover. The grate 98 is positioned within the upper body portion 38, such that the grate 98 is seated on the ledge 74. When the grate 98 is fully positioned within the body 14, an upper surface 100 of the grate 98 is substantially flush with the first end 18 of the body 14. More specifically, the grate 98 is substantially flush with the radially extending wall 86 of the flange 30. The grate 98 includes several openings 102 extending through the grate 98. Specifically, the openings 102 are elongate slots of different lengths extending in various directions. In alternative embodiments, the openings 102 may include different shapes (e.g., circular). Similarly to the openings 60, 84 on the strainer 54 and the sediment basket 82, the openings 102 are configured to permit the passage of fluid, while preventing large objects and debris, through the grate 98.

The lower body portion 42 is cylindrically shaped and positioned adjacent the second end 22 of the body 14. Specifically, the lower body portion 42 includes an axially extending wall 106 extending axially downward from the second end 50*b* of the angled wall 50. The axially extending wall 106 is shaped and sized to receive a pipe from the surrounding surface floor. In some embodiments, the lower body portion 42 may be secured to a pipe or alterative surrounding structure via a threaded connection or alternative fastening method.

The body 14 of the floor sink 10 illustrated in the embodiments is composed of polyvinyl chloride (PVC) material. However, in alternative embodiments, the body 14 of the floor sink 10 may be composed of an alternative material, such as stainless steel, cast iron, etc. In still further embodiments, the body 14 of the floor sink 10 may be composed of multiple different materials.

Figure 2:
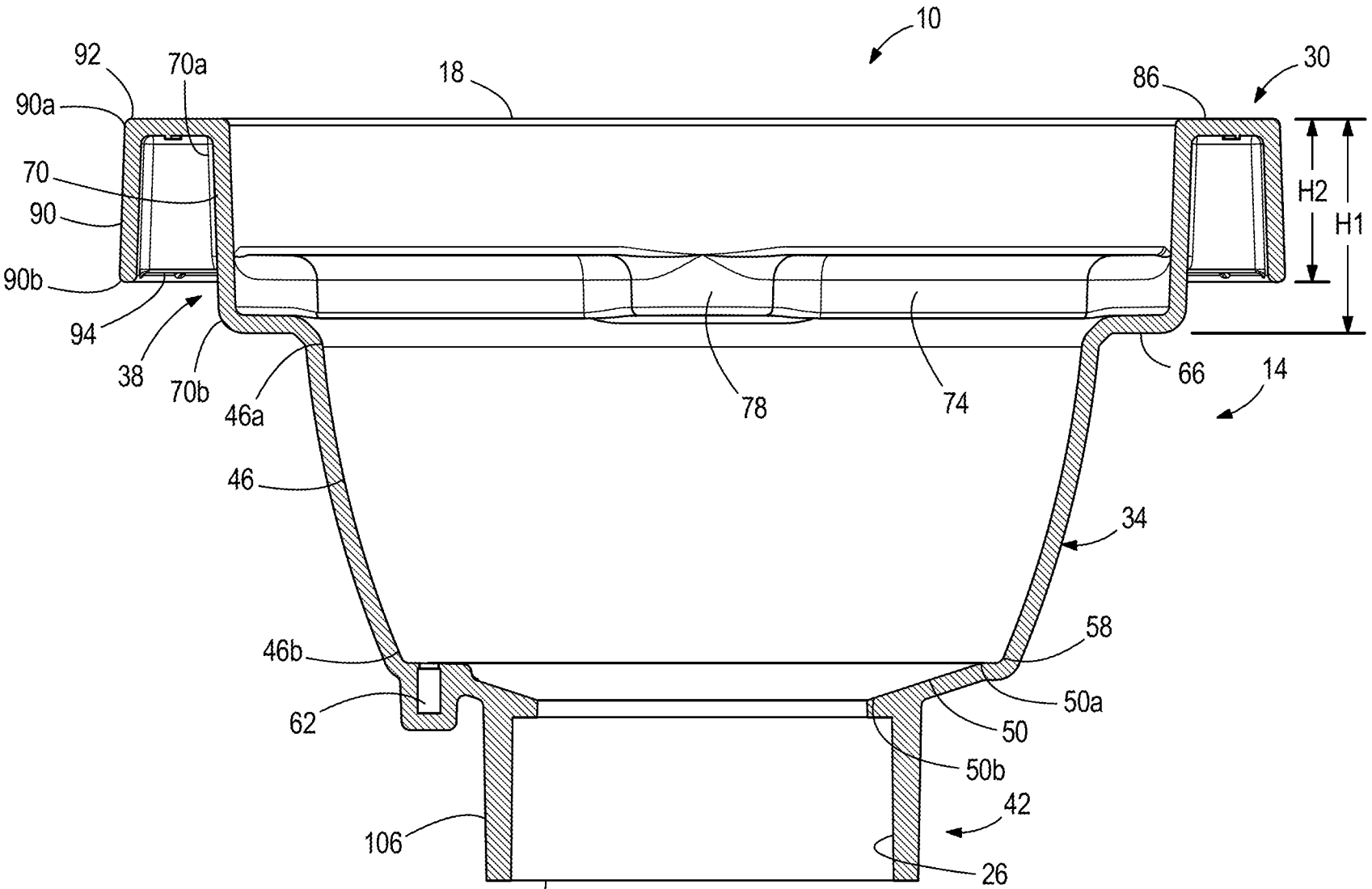
FIG. 2 is a front cross-sectional view of the floor sink of FIG. 1.

With reference to FIG. 2, the upper body portion 38 may have a height H1 (measured between the first end 70*a* and the second end 70*b* of the axially extending wall 70 of the upper body portion 38) that is between 1.0 and 3.0 inches. In other configurations height H1 is between 1.5 and 2.5 inches. Similarly, the flange 30 may have a height H2 (measured between the first end 90*a* and the second end 90*b* of the axially extending wall 90 of the flange 30) that is between 0.5 and 2.5 inches. In other configurations height H2 is between 1.0 and 2.0 inches. In one particular configuration, H1 is 2.0 inches and H2 is 1.5 inches. In such embodiments, the height H2 of the flange 30 overlaps with a portion of the height H1 of the upper body portion 38.

Figure 6:
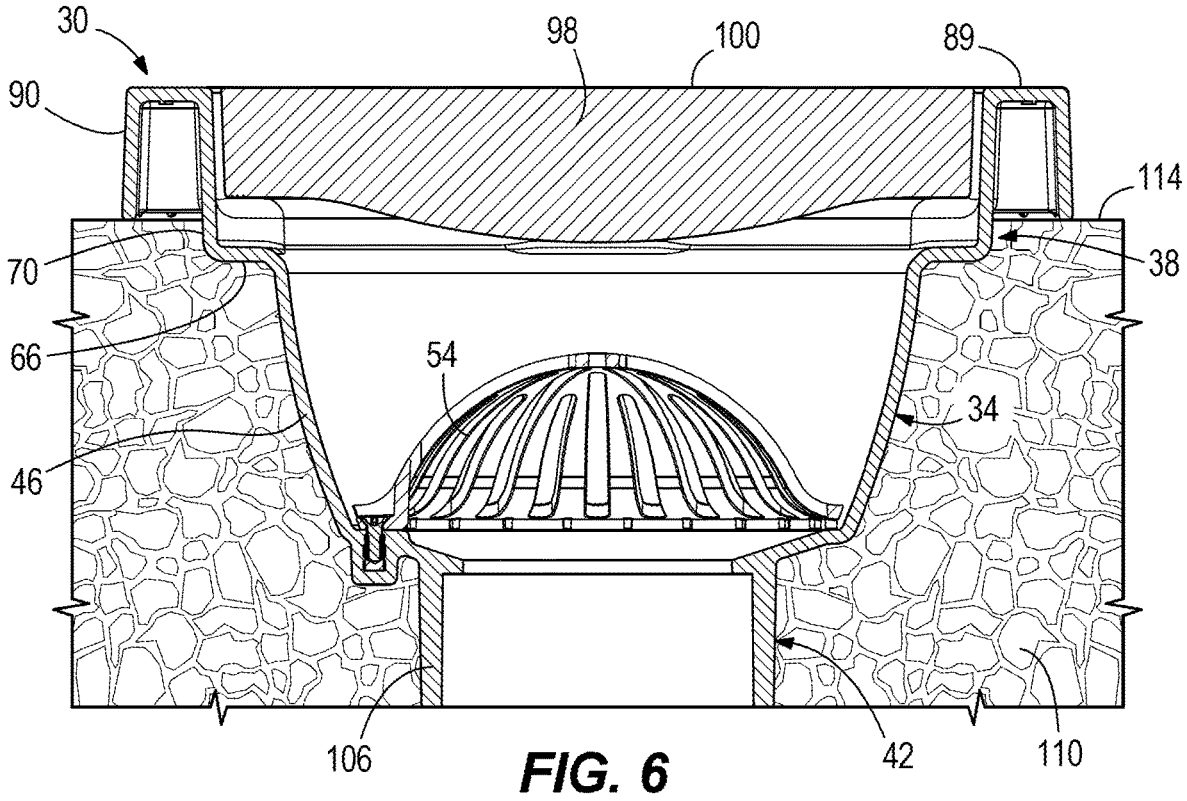
FIG. 6 is a front cross-sectional view of the floor sink of FIG. 1 positioned above a support surface.

During installation of the floor sink 10 into a surrounding floor 110, the first end 18 of the floor sink 10 (and the top surface 100 of the grate 98) may be positioned flush with a surface 114 of the floor 110 (FIG. 5), or the first end 18 of the floor sink 10 (and the top surface 100 of the grate 90) may protrude above the floor surface 114 (FIG. 6). When the first end 18 of the floor sink 10 is positioned flush with a floor surface 114, the flange 30 is fully positioned within the floor surface 114. Alternatively, when the first end 18 of the floor sink 10 is positioned above the floor surface 114, the second end 90*b* of the axially extending wall 90 of the flange 30 engages the floor surface 114. Therefore, the flange 30 is fully extended above the floor surface 114. Because the flange 30 includes the height H2 of approximately 1.5 inches, the illustrated floor sink 10 is compatible with building codes, which typically require floor sinks to extend at least 1 inch above a floor surface. Additionally, because the flange 30 extends at least 1 inch above the floor surface 114, grout does not need to be applied between the floor sink 10 and the floor surface 114, thereby eliminating potential sanitation issues.

Figure 7:
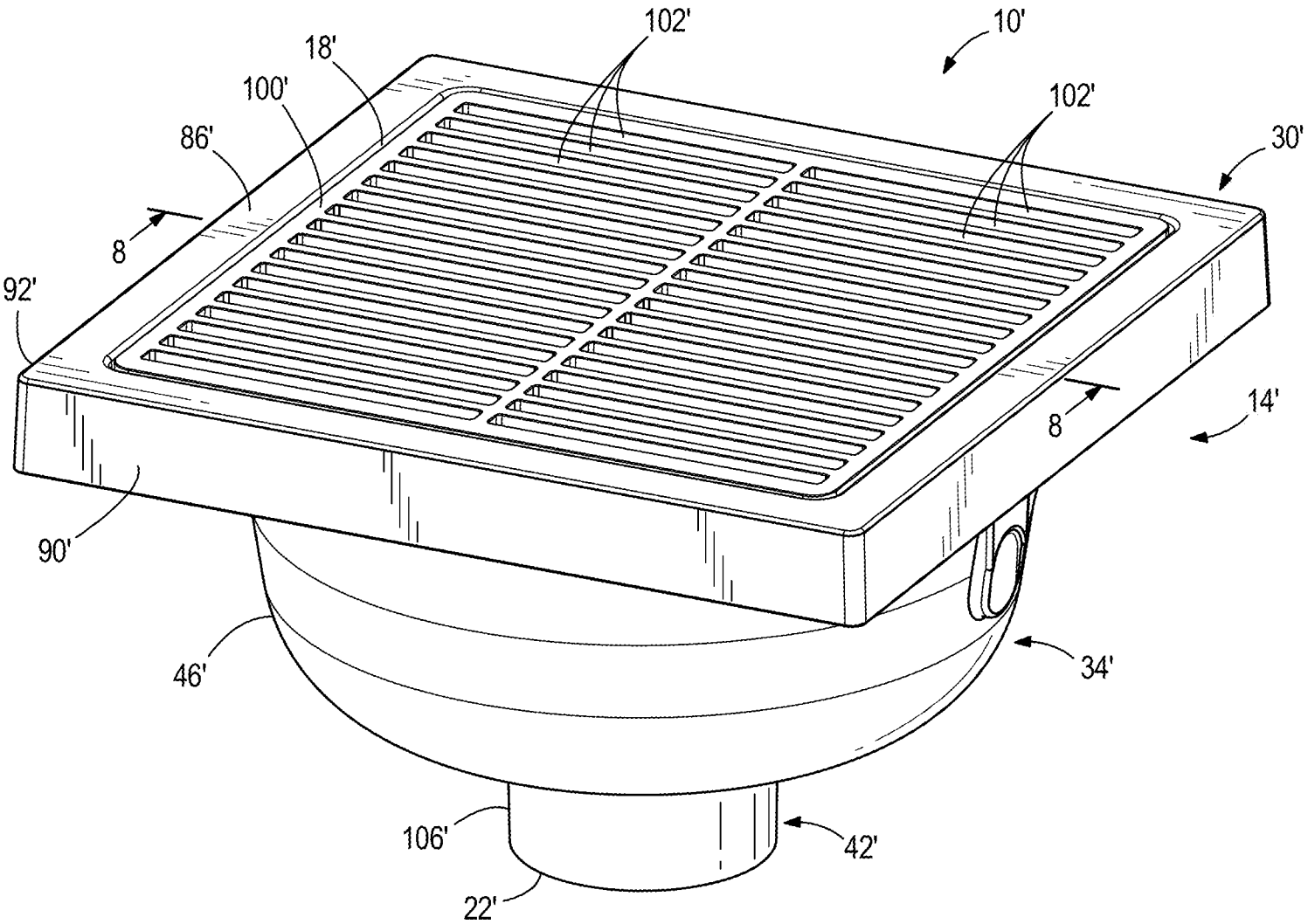
FIG. 7 is a front perspective view of an alternative floor sink embodying the invention.
Figure 8:
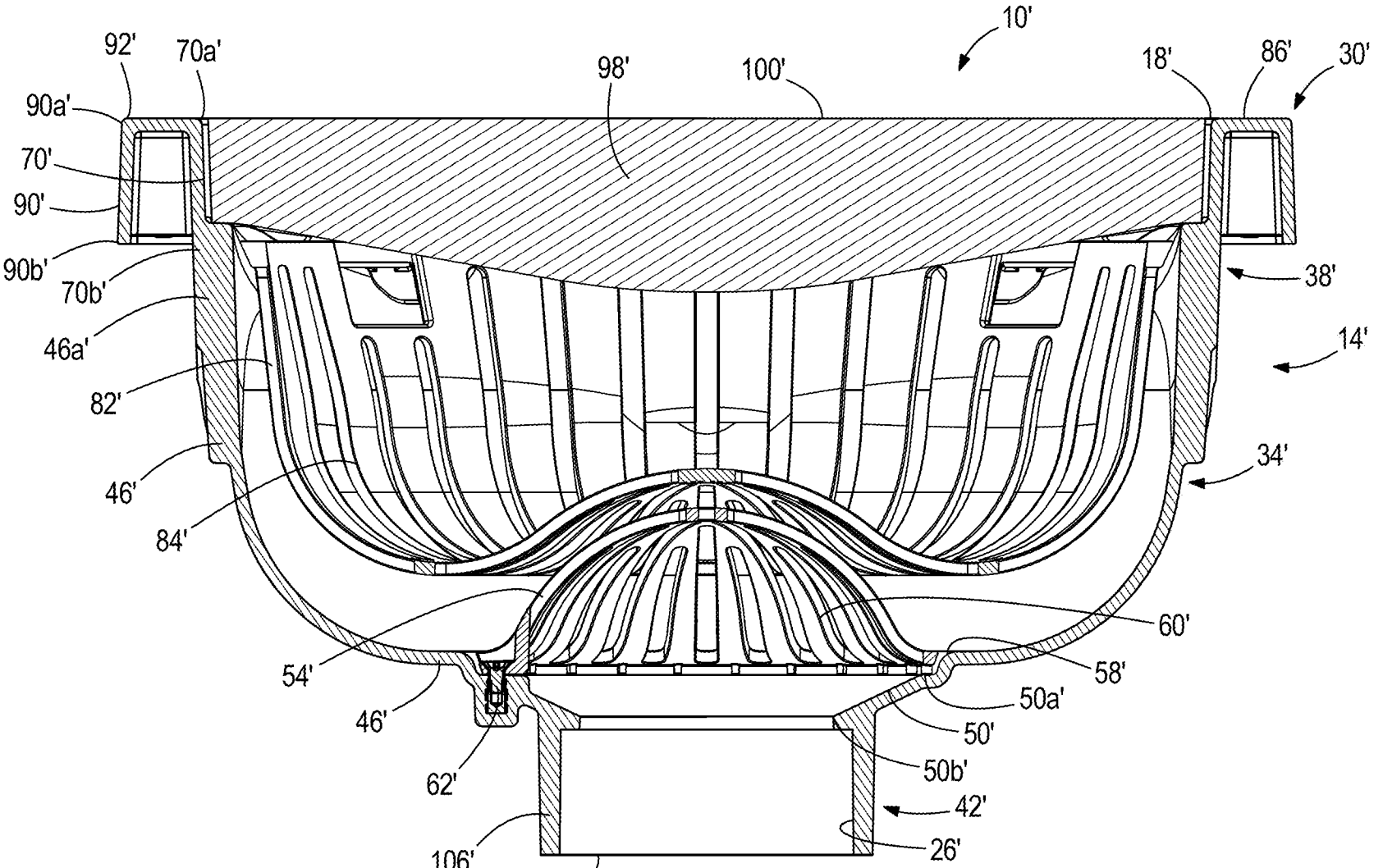
FIG. 8 is a front cross-sectional view of the floor sink of FIG. 7.

FIGS. 7-8 illustrate an alternative floor sink 10'. The illustrated floor sink 10' is similar to the floor sink 10 described above and includes like parts. Reference is hereby made to the description of the floor sink 10 shown in FIGS. 7-8 for description of features and elements of the floor sink 10' not specifically included below. The floor sink 10' includes an alternative shape, which will be described below. Components that are similar to those described in the floor sink 10 have the same reference number plus an apostrophe.

The illustrated floor sink 10' includes the body 14' having the main body portion 34', the upper body portion 38' adjacent the first end of the body 14', and the lower body portion 42' adjacent the second end 22' of the body 14'. With reference to FIG. 7, the main body portion 34' is substantially circular. The contoured wall 46' and the angled wall 50' are shaped and sized to receive the strainer 54' within the main body portion 34'. Specifically, the strainer 54' may be positioned on the edge 58' formed between the contoured wall 46' and the angled wall 50'. Additionally, the contoured wall 46' and the angled wall 50' are shaped and sized to receive the sediment basket 82'. Specifically, the contoured wall 46' may include rounded portions conforming to the shape of the sediment basket 82'. The sediment basket 82' is positioned within the main body portion 34' and above the strainer 54'.

The upper body portion 38' and the flange 30' are rectangular (e.g., square) shaped. Specifically, the axially extending wall 70', the radially extending wall 86', and the axially extending wall 90' form a rectangular shape. With reference to FIG. 8, the upper body portion 38' includes only the axially extending wall 70'. The axially extending wall 70' is connected to the contoured wall 46' of the main body portion 34'. The ledge 74' protrudes from an inner surface of the axially extending wall 70'. The ledge 74' is rectangular and includes four recesses 78' positioned on the corners of the ledge 74'. The ledge 74' is shaped and sized to receive the grate 98', or alternative cover. The grate 98' includes several openings 102' extending through the grate 98'. Specifically, the openings 102' are elongate, rectangular slots of an identical shape and size. In alternative embodiments, the openings 102' may include different shapes (e.g., circular). The openings 102' are configured to permit the passage of fluid, while preventing large objects and debris, through the grate 98'.

Although the invention has been described in detail with reference to certain preferred embodiments, variations and modifications exist within the scope and spirit of one or more independent aspects of the invention as described.

What is claimed is:

1. A floor sink configured to be installed in a support surface, the floor sink comprising:

a body including a first end, and a second end opposite the first end and configured to receive a pipe;

a cavity extending through the body; and a flange coupled to the first end of the body and extending away from the cavity, wherein the flange is configured to engage the support surface, and wherein the flange includes a surface; and a plurality of ribs extending between the surface of the flange and an outer surface of the body.

2. The floor sink of claim 1, wherein the flange is annular.

3. The floor sink of claim 1, wherein the flange is rectangular.

4. The floor sink of claim 1, wherein the flange includes a radially extending wall and an axially extending wall.

5. The floor sink of claim 4, further comprising a channel positioned between the radially extending wall and the axially extending wall.

6. The floor sink of claim 1, further comprising a ledge protruding along an inner surface body.

7. The floor sink of claim 6, further comprising a grate positioned within the body, wherein the grate is positioned on the ledge.

8. The floor sink of claim 6, further comprising a strainer positioned within the body, wherein the strainer engages the ledge.

9. A floor sink configured to be installed in a support surface, the floor sink comprising:

a body including a first end, and a second end opposite the first end and configured to receive a pipe, wherein the body also includes a radially extending wall and an axially extending wall;

a cavity extending through the body;

a flange coupled to the first end of the body and extending away from the cavity, the flange including a first wall, a second wall oriented perpendicular to the first wall, and a channel formed between the first wall and the second wall; and a plurality of ribs extending between the axially extending wall and the second wall.

10. The floor sink of claim 9, wherein the first wall extends perpendicular to the axially extending wall, and the second wall extends parallel to the axially extending wall.

11. The floor sink of claim 9, wherein the axially extending wall includes a first height, and the flange includes a second height, wherein the first height is greater than the second height.

12. The floor sink of claim 11, wherein the second height is measured from a first end of the second wall to a second end of the second wall.

* * * * *